US008627987B2

(12) United States Patent
Pollack et al.

(10) Patent No.: US 8,627,987 B2
(45) Date of Patent: Jan. 14, 2014

(54) CONTAINER WITH ELEVATING INNER WALL

(75) Inventors: Birgit Leisen Pollack, Oshkosh, WI (US); Michael Andrew Ludka, Greenfield, WI (US); Allison Amanda Popple, Manitowoc, WI (US)

(73) Assignee: WiSys Technology Foundation, Madison, WI (US)

( * ) Notice: Subject to any disclaimer, the term of this patent is extended or adjusted under 35 U.S.C. 154(b) by 107 days.

(21) Appl. No.: 13/217,923

(22) Filed: Aug. 25, 2011

(65) Prior Publication Data

US 2012/0074174 A1 Mar. 29, 2012

Related U.S. Application Data

(60) Provisional application No. 61/376,883, filed on Aug. 25, 2010.

(51) Int. Cl.
*G01F 11/00* (2006.01)

(52) U.S. Cl.
USPC ..... 222/405; 222/386; 222/390; 222/386.5; 220/8; 401/170

(58) Field of Classification Search
USPC ..... 222/390, 386, 205, 405, 398, 386.5; 220/8; 401/170
See application file for complete search history.

(56) References Cited

U.S. PATENT DOCUMENTS 1,025,512 A * 5/1912 Craven ..... 222/390
2,098,356 A * 11/1937 Pfefferkorn et al. ..... 220/4.27
2,099,595 A * 11/1937 Brown ..... 222/105
2,328,973 A * 9/1943 Goldfisher ..... 401/11
2,627,365 A * 2/1953 Gabler ..... 222/326
2,635,789 A * 4/1953 Gabler ..... 222/327
2,728,494 A * 12/1955 Hobson ..... 222/386.5
2,818,973 A * 1/1958 Croce et al. ..... 401/75
2,845,707 A * 8/1958 Redmond ..... 222/390
2,880,902 A * 4/1959 Owsen ..... 220/8
3,107,643 A * 10/1963 Edwards ..... 440/100
3,128,923 A * 4/1964 Gabler ..... 222/390
3,241,729 A * 3/1966 Gabler ..... 222/390
3,325,063 A * 6/1967 Hansen ..... 222/390
3,706,394 A * 12/1972 Merz ..... 221/75
4,258,865 A * 3/1981 Vahl et al. ..... 222/213
4,602,728 A * 7/1986 Ha ..... 222/528
4,927,191 A * 5/1990 Mikol ..... 285/226
4,950,094 A * 8/1990 Yorks ..... 401/75
5,037,010 A * 8/1991 Dikstein ..... 222/390
5,152,434 A * 10/1992 Birmelin ..... 222/207
5,312,019 A * 5/1994 Tsao ..... 222/105
5,348,197 A * 9/1994 Mizzi et al. ..... 222/401
5,348,198 A * 9/1994 Mizzi et al. ..... 222/401
5,356,037 A * 10/1994 Harrold ..... 222/95
5,417,337 A * 5/1995 Robbins, III ..... 220/8
5,439,178 A * 8/1995 Peterson ..... 239/333
5,753,212 A * 5/1998 Pescatore et al. ..... 424/65
5,788,120 A * 8/1998 Stumler ..... 222/95

(Continued)

*Primary Examiner* — Paul R Durand
*Assistant Examiner* — Randall Gruby
(74) *Attorney, Agent, or Firm* — Boyle Fredrickson S.C.

(57) ABSTRACT

A container, for example for a food product or the like, provides an elevating lower inner surface that may sealably support a contained food product to raise the upper surface of the food product as it is consumed. Importantly, the container avoids an extension of the elevating mechanism into the product itself, reducing problems of contamination and leakage.

18 Claims, 11 Drawing Sheets

(56) References Cited

U.S. PATENT DOCUMENTS

| | | | | |
|---|---|---|---|---|
| 5,851,078 | A * | 12/1998 | Bow et al. | 401/78 |
| 5,992,705 | A * | 11/1999 | Lhuisset | 222/386 |
| 6,105,803 | A * | 8/2000 | Standish | 220/8 |
| 6,655,551 | B2 * | 12/2003 | Manne | 222/145.6 |
| 6,655,557 | B2 * | 12/2003 | Rousselet et al. | 222/391 |
| 6,681,957 | B1 * | 1/2004 | Green | 222/135 |
| 7,467,734 | B2 * | 12/2008 | Bocola | 222/390 |
| 7,475,631 | B2 * | 1/2009 | Chen | 99/353 |
| 7,475,633 | B2 * | 1/2009 | Weinberg | 100/289 |
| 7,886,782 | B1 * | 2/2011 | Curtis | 141/338 |
| 8,157,114 | B2 * | 4/2012 | Baylous et al. | 215/3 |
| 8,267,271 | B2 * | 9/2012 | Faris | 220/8 |
| 8,297,867 | B2 * | 10/2012 | Nasu et al. | 401/175 |
| 8,333,298 | B2 * | 12/2012 | Wojcik et al. | 220/666 |
| 2002/0036214 | A1 * | 3/2002 | Rousselet et al. | 222/391 |
| 2003/0010336 | A1 * | 1/2003 | Vito | 128/200.22 |
| 2003/0071040 | A1 * | 4/2003 | Brodner et al. | 220/23.87 |
| 2003/0168366 | A1 * | 9/2003 | Hirsiger et al. | 206/365 |
| 2004/0007599 | A1 * | 1/2004 | Tani | 222/390 |
| 2010/0133281 | A1 * | 6/2010 | Wojcik et al. | 220/666 |
| 2010/0193460 | A1 * | 8/2010 | Driver et al. | 215/11.3 |
| 2011/0127299 | A1 * | 6/2011 | Calkins | 222/390 |
| 2011/0248037 | A1 * | 10/2011 | Fung | 220/592.2 |
| 2012/0198970 | A1 * | 8/2012 | Robidoux | 81/121.1 |

* cited by examiner

CONTAINER WITH ELEVATING INNER WALL

CROSS-REFERENCE TO RELATED CASES

This application claims the benefit of U.S. provisional application 61/376,883 filed Aug. 25, 2010 and hereby incorporated by reference.

BACKGROUND OF THE INVENTION

The present invention relates to containers for food items and similar products and in particular to a container having an elevating inner wall employing an elevating mechanism that does not extend into the product or outside of the container during use.

Certain food products, for example, salsa, may be enjoyed by dipping chips or the like directly into the product. For this purpose, the product may be emptied from its original container into a shallow bowl suitable for this purpose.

It would be desirable to be able to dip some food products directly into the container to avoid the need for a separate dish and to permit the casual enjoyment of the product in a variety of different environments including those where a separate dish is impractical or inappropriate. Dipping products directly into the container works relatively well when the container is full, but it can be difficult or impossible as the food product is consumed and its upper surface drops into the container. This problem can be lessened by the use of extremely shallow containers; however, such containers can be impractical in the stream of commerce and unattractive to the end consumer.

SUMMARY OF THE INVENTION

The present invention provides a container for salsa or the like that has an elevating lower inner surface that may sealably support a contained food product to raise the upper surface of the food product as it is consumed. Importantly, the container avoids an extension of the elevating mechanism into the product itself, reducing problems of contamination and leakage. Further, the mechanism is compact and wholly contained within the container to provide practical shipping and storage of the container.

Specifically, the present invention may provide a container having a base surrounded by substantially rigid upstanding outer sidewalls terminating at an upper lip for receiving a lid, the base movably held within the sidewalls to move upward therein. An inner collapsible sidewall has an upper edge elevationally fixed with respect to the upper lip and a lower edge elevationally movable with the base.

It is thus an object of at least one embodiment of the invention to provide a packaging container that simplifies dispensing amorphous or fluid-like materials by allowing the product to be elevated within the container as it is consumed.

The inner collapsible sidewalls may comprise a set of telescoping rings.

It is thus an object of at least one embodiment of the invention to provide for an inner wall system that may protect an elevating mechanism from contact with the contained product.

The container may further include a set of inter-engaging thread elements having a first portion attached to the base so that relative rotation of the inter-engaging thread elements causes upward movement of the base.

It is thus an object of at least one embodiment of the invention to provide a precise elevational mechanism that is resistant to accidental displacement. The thread mechanism allows precise elevational control while offering resistance against unintended elevational changes by normal friction amplified by the mechanical advantage of the thread.

A second portion of the inter-engaging thread elements may be a helical groove attached to an inner wall of the upstanding outer sidewalls so that rotation of the base causes it to climb upward within the outer sidewalls.

It is thus an object of at least one embodiment of the invention to reduce the necessary material for fabrication of the container by integrating the threads into the outer container walls.

The container may further include a knob rotatable about a vertical axis and communicating with the base to rotate the base with rotation of the knob.

It is thus an object of at least one embodiment of the invention to provide a simple and convenient control surface for the consumer.

The knob may provide an outer base to the container.

It is thus an object of at least one embodiment of the invention to provide a control surface for elevating the base that may be simply integrated into the container outer surface.

The knob may include upwardly extending pins positioned between the upstanding outer sidewalls and the inner collapsible sidewalls to be received within channels in the base to cause rotation of the base while permitting separation of the base and knob with rotation of the knob.

It is thus an object of at least one embodiment of the invention to provide a simple mechanism that provides a strong communication of torque between the knob and base while allowing freedom of separation between the two.

These particular objects and advantages may apply to only some embodiments falling within the claims and thus do not define the scope of the invention.

DETAILED DESCRIPTION OF THE PREFERRED EMBODIMENT

Figure 1:
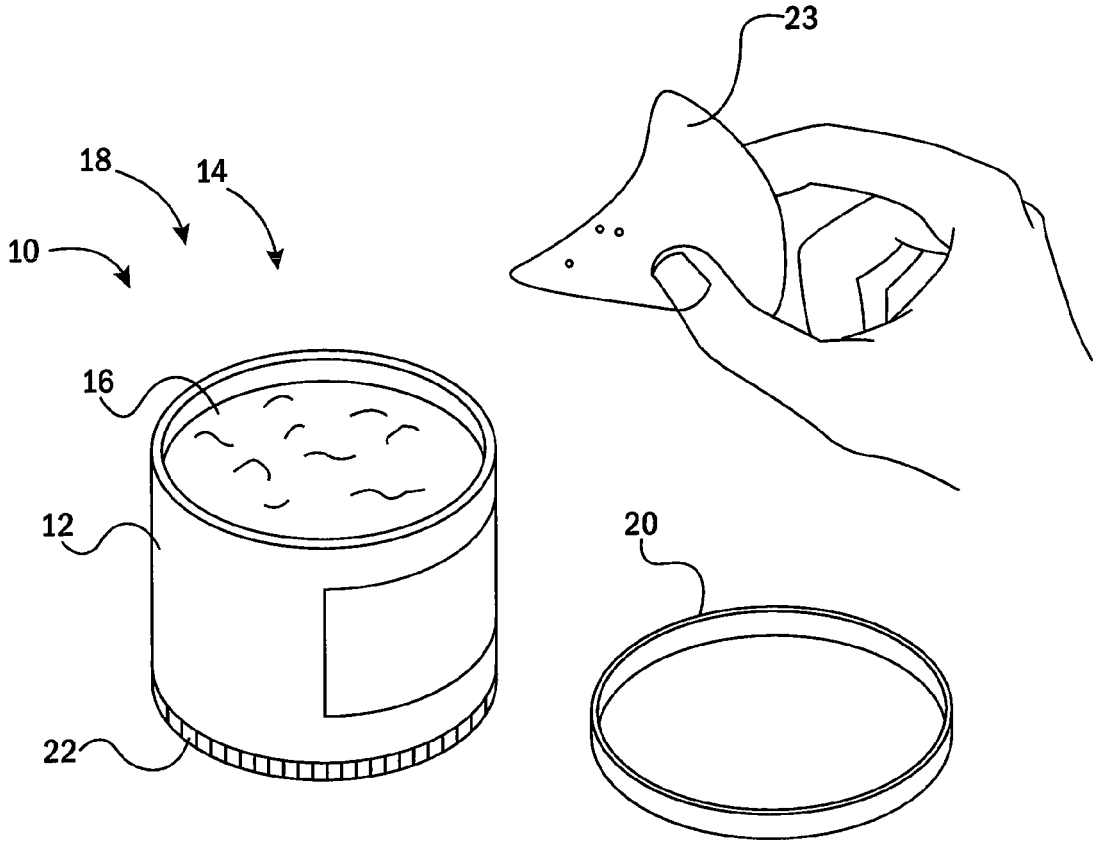
FIG. 1 is a perspective view of a salsa container constructed per the present invention as may be used for dipping salsa directly from the container.

Referring now to FIG. 1, a container 10 of the present invention may provide an outer wall 12 defining, for example, a cylindrical inner volume 14 holding a food product 16 such as salsa accessible through an open end 18. The open end 18 may be covered by a removable lid 20, for example, by means of a threaded engagement between threads on the open end 18 and corresponding inner threads on the lid 20 as understood in the art. The lid 20 may include a gasket to sealably hold the food products 16 in the container 10 when the lid 20 is tightened.

The container 10 may rest on a bottom wall 22, for example, providing a planar surface for support against a table or the like. The food products 16 may be exposed through the open end 18 of the container 10 for dipping with chips 23 or the like.

Figure 2:
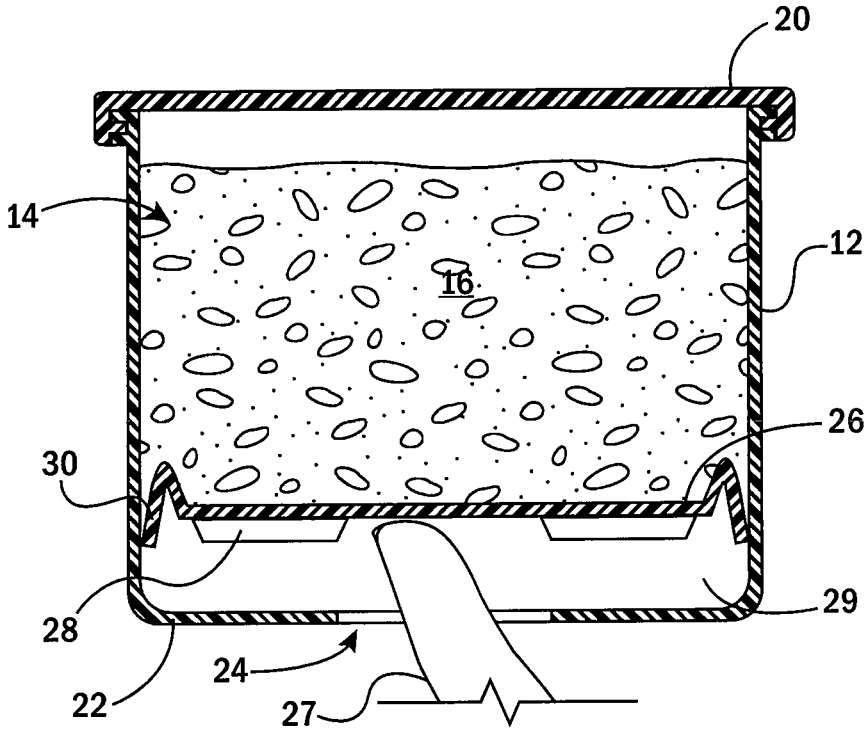
FIG. 2 is an elevational cross-section through a first embodiment of the invention showing a false bottom that may be pressed upward through a hole in the actual bottom as product is consumed.

Referring now to FIG. 2, in a first embodiment the bottom wall 22 may have an open central aperture 24 through which, for example, a user's thumb 27 may be inserted to push upward against a false bottom 26 positioned above the bottom wall 22 and extending parallel to the bottom wall 22 fully across the inner volume 14 to sealably separate the food products 16 from a space 29 beneath the false bottom 26. The false bottom 26 may, for example, be constructed of a resilient plastic having downwardly extending stiffening fins 28 to preserve its planar configuration and downwardly extending sealing flanges 30 resiliently biased outward to press against the inner surface of the outer walls 12 to prevent leakage past the false bottom 26.

Figure 3:
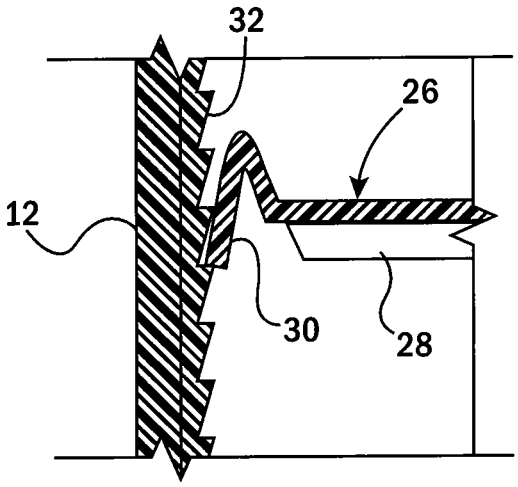
FIG. 3 is a fragmentary detail view of FIG. 2 showing a ratchet mechanism incorporated into the walls of the container to hold the bottom in place as it is pressed upward.

Referring to FIG. 3, in one embodiment the inner surfaces of the walls 12 may include serrated ratchet teeth 32 that may engage the downwardly extending flanges 30 in the manner of a pawl on a ratchet so as to prevent downward movement of the false bottom 26 once it has been pressed upward.

Figure 4:
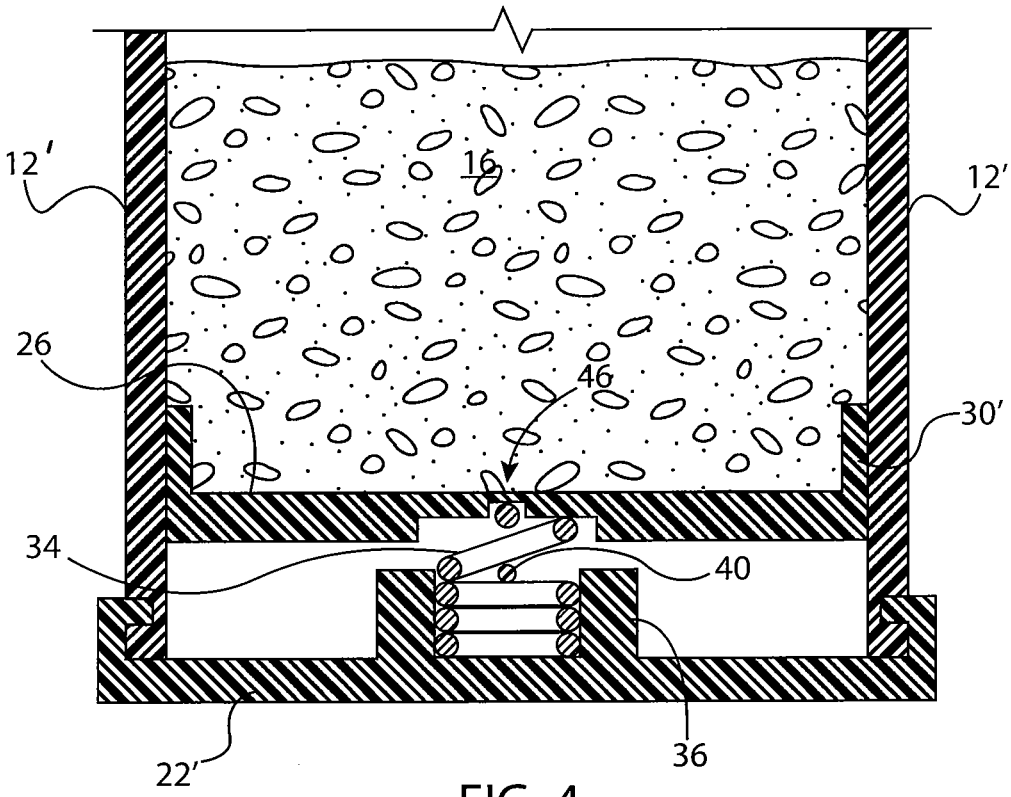
FIG. 4 is an elevational cross-section of a second embodiment of the invention providing an elevating screw formed from a compressed helical spring that may be uncoiled by rotation of the base of the container.

Referring now to FIG. 4, in an alternative embodiment the false bottom 26 may have upwardly extending sealing flanges 30' to be pressed outward with downward pressure by the food products 16. False bottom 26 may be supported by an upper end of a coiled helical spring 34 held in partial coiled compression within a pocket 36 formed in a rotatable bottom wall 22'. The pocket 36 includes a horizontal peg 40 extending radially through the axis of the spring 34 to hold it in compression within the pocket 36.

Figure 5:
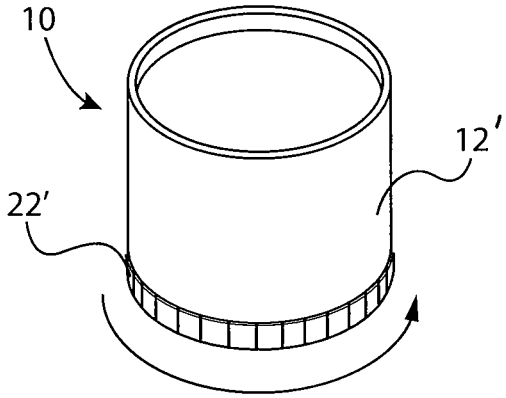
FIG. 5 is a perspective view of the container of FIG. 4 showing rotation of the base to uncoil the compressed spring.
Figure 6:
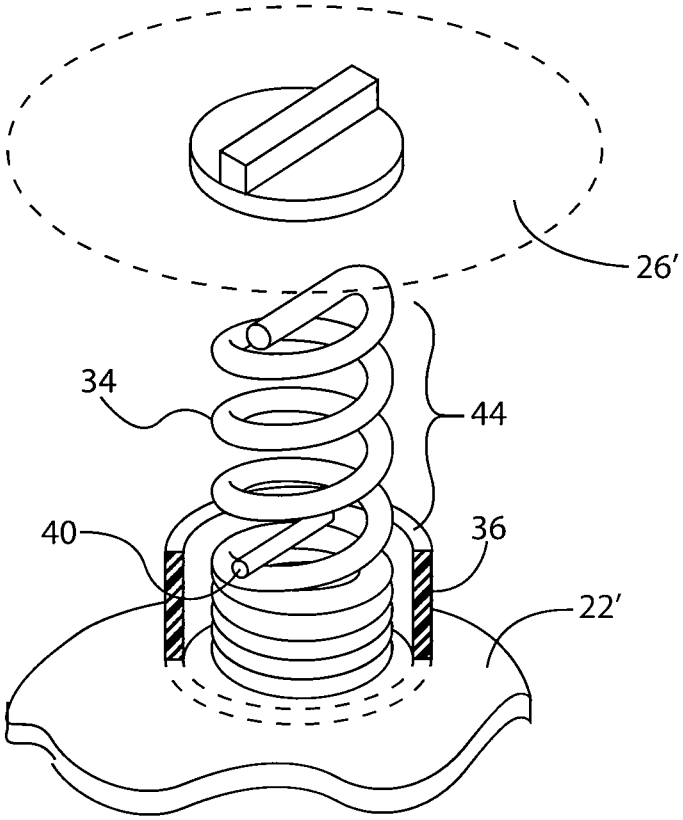
FIG. 6 is a fragmentary cross-section of a portion of the base holding the compressed spring showing the uncoiling process.

Referring to FIGS. 5 and 6, rotation of the bottom wall 22' with respect to the upward wall 12' causes a retaining peg 40 to rotate with respect to the spring 34 to uncoil a portion of the spring 34 compressed within the pocket releasing it into an uncoiled portion 44 extending upward from the pocket 36 to press upward on the false bottom 26. The spring 34 thereby provides a collapsible lead screw lifting the false bottom 26 upward. Yet unlike a lead screw, the spring 34 is collapsed in the pocket 36 as not to extend into the products 16 or beneath the bottom wall 22'. An upper portion of the spring 34 may be retained against rotation when the bottom wall 22 is rotated by a corresponding notch 46 in the bottom of the false bottom 26'.

Figure 8:
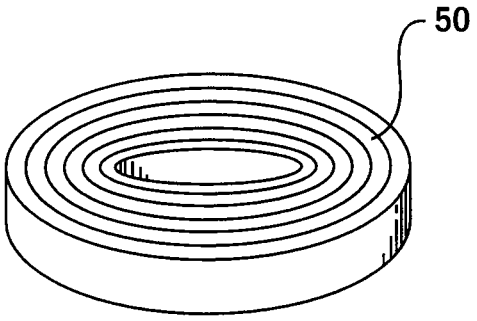
FIG. 8 is a figure similar to that of FIG. 7 showing the shroud in collapsed form.
Figure 7:
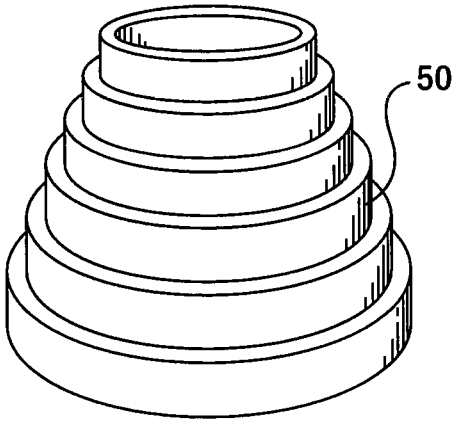
FIG. 7 is a perspective view of a telescoping shroud that may be used to cover the spring mechanism or the opening of the above embodiments, the shroud shown in an extended form.

Referring now to FIG. 7, the spring 34 and pocket 36 of the embodiment of FIGS. 4-6 or the aperture 24 of the embodiment of FIG. 2 may be covered by a telescoping shroud 50 to further separate the mechanism or user's digits from the food products 16. The shroud 50 may comprise a set of concentric rings with vertical walls having radially inward upper lips and radial outward lower lips that serve to connect them in full extension to their inner and outer rings. Thus the shroud 50 may collapse fully as shown in FIG. 8 to the height of one ring and extend as shown in FIG. 7 to the combined heights of the rings.

Figure 9:
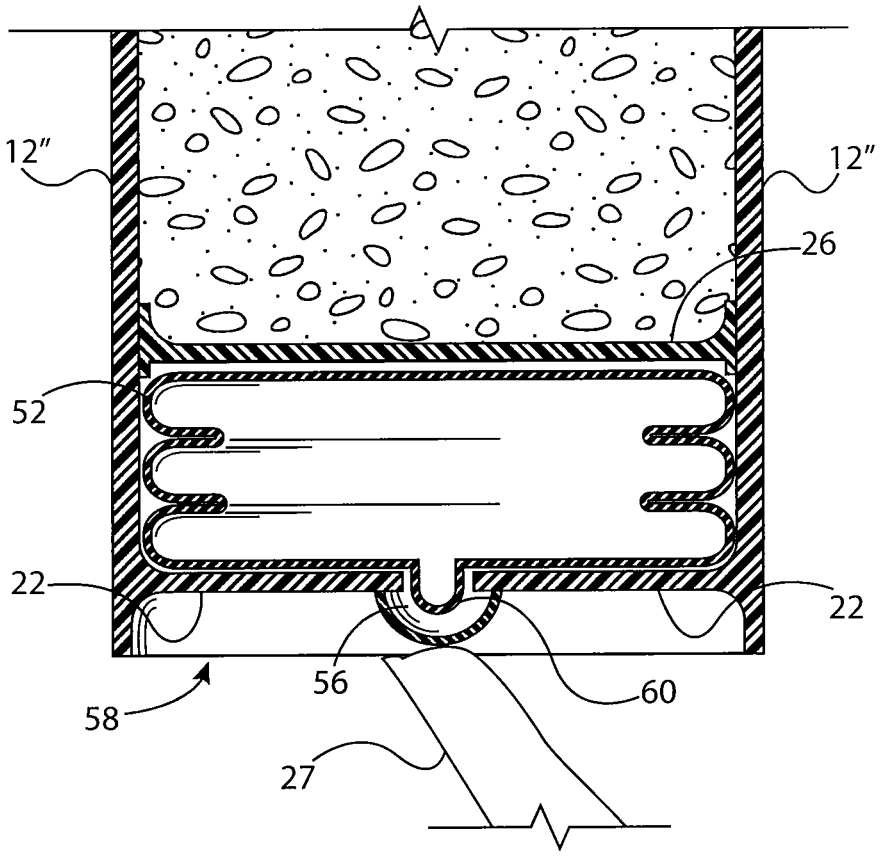
FIG. 9 is an elevational, cross-sectional view of a third embodiment of the invention employing an inflatable bladder and pump to elevate a false bottom.
Figure 10:
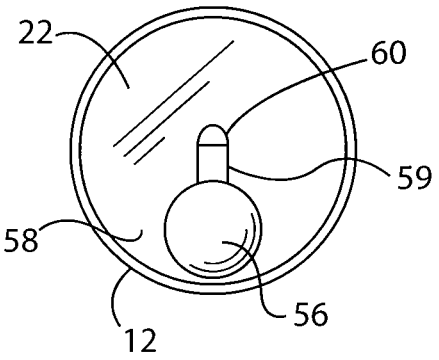
FIG. 10 is a bottom plan view of the container of FIG. 9 showing the offsetting of the pump from the bladder.
Figure 11:
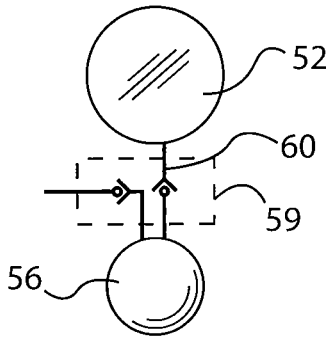
FIG. 11 is a block diagram of check valves used between the pump and bladder.

Referring to FIG. 9, in an alternative embodiment, the false bottom 26 may be elevated by means of a bellows-shaped inflatable bladder 52 that may collapse when uninflated and when inflated may exert an upward force on the false bottom 26. Inflation may be provided by means of a press bulb 56 retained in a cavity 58 beneath the bottom wall 22. Referring to FIGS. 10 and 11 as well as FIG. 9, the press bulb 56 may connect to the bladder 52 through a check valve 59 leading to an inlet port 60 of the bladder 52. The check valve 59 may provide for one-way passage of airflow from the ambient air into the press bulb 56 and then a one-way passage of air from the press bulb 56 through the inlet port 60 to the bladder 52. A release valve (not shown) may also be provided to permit deflation of the bladder 52

Figure 12:
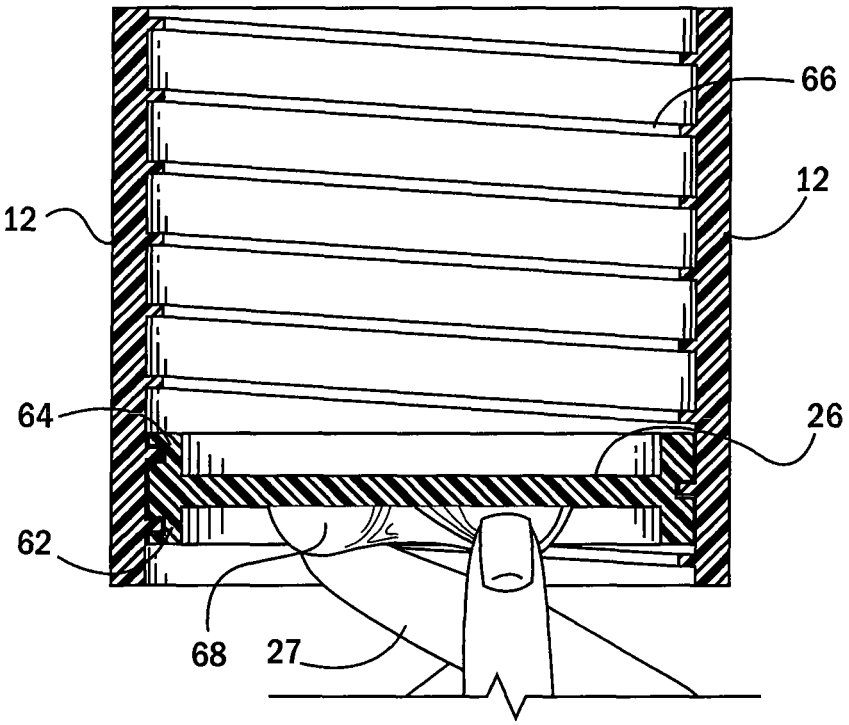
FIG. 12 is an elevational cross-section through a fourth embodiment of the invention showing a false bottom engaging internal threads on the container.
Figure 13:
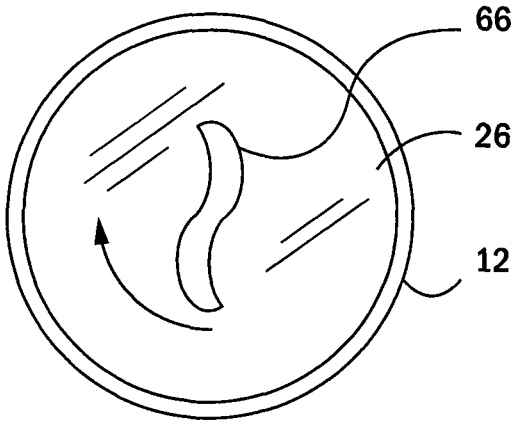
FIG. 13 is a bottom plan view of the container of FIG. 12.

Referring now to FIG. 12, in an alternative embodiment, the false bottom 26 may provide for an outer ring-shaped flange 62 conforming generally to the inner surface of the outer walls 12 of the container 10 in diameter and having outwardly exposed threads 64 engaging corresponding inwardly facing threads 66 on the inner surface of the wall 12. A gripping flange 68 extending downward from the lower surface of the false bottom 26 may provide purchased for the user's thumb and fingers to allow the false bottom 26 to be rotated upward to raise the false bottom 26 by its climbing on the thread 66. The gripping flange 68 may have beveled surfaces to promote only proper rotation of the gripping flange 68 in a direction that would provide for elevation of the false bottom 26.

Figure 14:
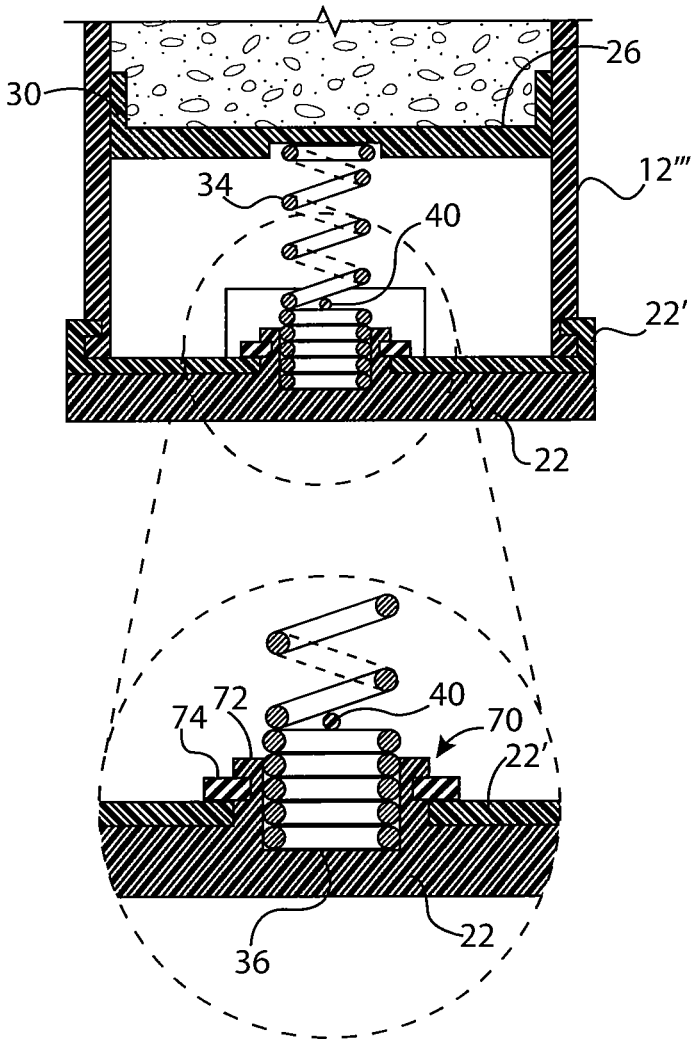
FIG. 14 is a fragmentary elevational cross-section similar to FIG. 4 showing an alternative embodiment of the mechanism of FIG. 4.

Referring now to FIG. 14, an alternative version of the embodiment of FIG. 4, described above, may provide for a fixed (non-rotatable bottom wall 22') having a central aperture 70 allowing lips 72 of the tubular pocket 36 formed in the rotatable bottom wall 22 to extend upward therethrough. The rotatable bottom wall 22 abuts the lower surface of the non-rotatable bottom wall 22'. The lips 72 may be retained by a C-clip 74 or the like engaging a groove in the outer periphery of the lips 72 and sliding against an upper surface of the non-rotating wall 22'. In this case, the retaining peg 40 may be attached to the non-rotatable bottom wall 22' eliminating the need for the spring 34 to be retained against rotation by the bottom surface of the false bottom 26 but allowing the spring 34 to be rotationally fixed to the pocket 36 to turn therewith. It will be understood that this version easily permits the container to be a non-cylindrical shape such as oval or rectangular in cross-section.

Figure 15:
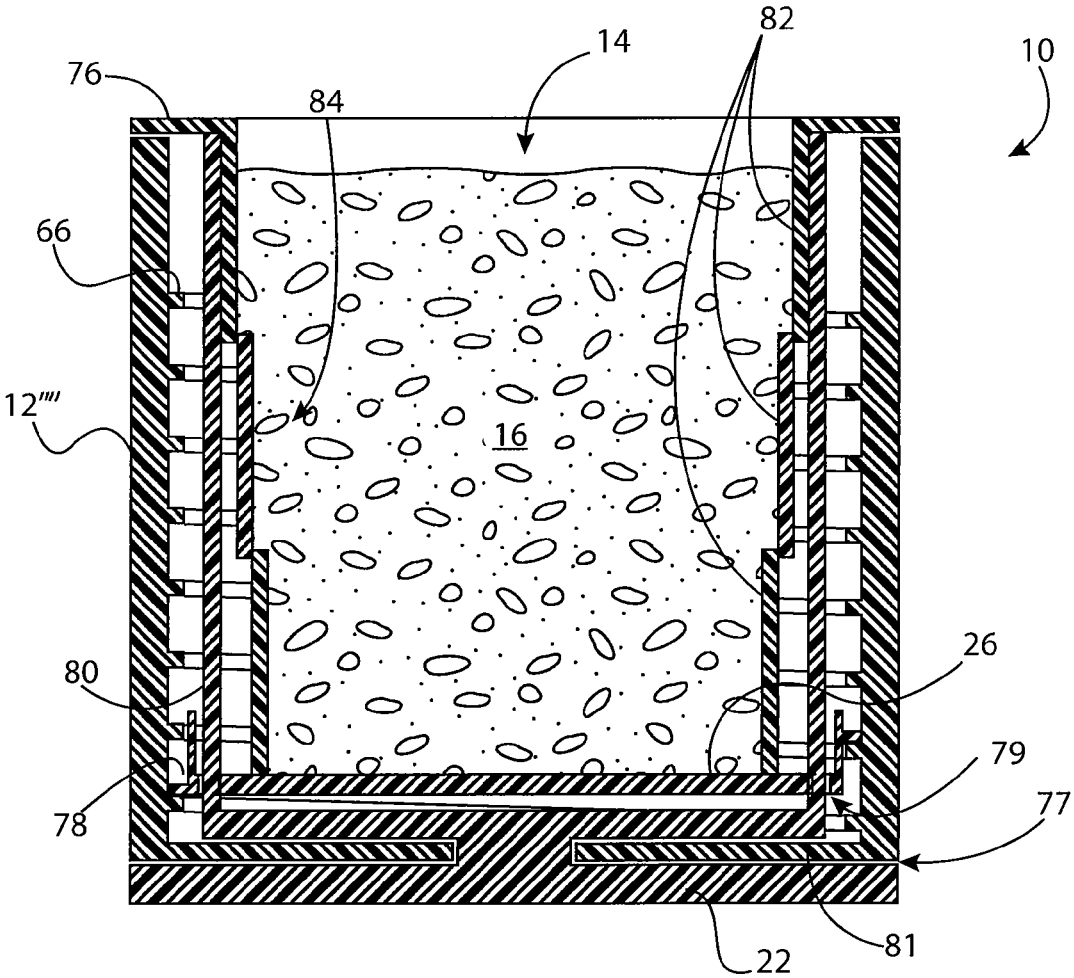
FIG. 15 is an elevational cross-section of a fifth embodiment of the invention providing an inner telescoping wall separating contained product from a threaded engagement between the bottom and inner wall of the container showing the container in a full state.

Referring now to FIG. 15, an alternative version of the embodiment of FIG. 12, described above, may provide a means for elevating the false bottom 26 remote from the false bottom 26. In this embodiment, the outer wall 12"" is formed independently of the bottom wall 22 so that the bottom wall 22 may rotate in relation to the outer wall 12"". The bottom wall 22 is constrained against vertical motion by entering engagement of a peripheral channel 77 extending radially inward around the bottom wall has engaged by inwardly extending flanges 81 extending inwardly from the lower edge of the outer walls 12"". The inwardly extending flanges 81 separate the bottom wall into an outer portion that may be grasped by the user for rotation and an inner portion inside the container.

The portion of the bottom wall 22 inside the container has attached two vertically-extending struts 80, attached to the bottom wall 22 at diametrically opposed points separated by a distance less than the diameter of the outer wall 12"" but greater than the diameter of a top-most cylindrical nesting ring 82, to be described in greater detail later. The vertically-extending struts 80 may terminate before reaching the top lip 76 of the container 10 or may be attached to the top lip 76, so long as the top lip 76 is rotationally independent from the outer wall 12"".

The false bottom 26 is formed with two apertures 79 through which the vertically-extending struts 80 extend, connecting the false bottom 26 to the bottom wall 22 such that the false bottom 26 is rotationally engaged with the bottom wall 22 but remains elevationally independent.

The false bottom 26 has a threaded exterior wall 78 that engages with the corresponding thread 66 of the outer wall 12""; thus, when the false bottom 26 rotates in relation to the outer wall 12"", the false bottom 26 is moved upward. The user may rotate the false bottom 26 in relation to the outer wall 12"" without needing access to the false bottom 26 because it is rotationally coupled to the bottom wall 22 by the struts 80. Alternatively, the user may grip the bottom wall 22, keeping it stationary, and rotate the outer wall 12"" to achieve the intended elevation.

The false bottom 26 is, in this embodiment, permanently attached to the smallest of a set of cylindrical nesting rings 82. Collectively, the cylindrical nesting rings 82 form the exterior wall of the inner volume 14 containing the food product 16, and when the smallest of the cylindrical nesting rings 82 is so attached to the false bottom 26, a telescoping cup 84 is formed. The nesting ring 82 of greatest diameter may include the top lip 76.

Figure 16:
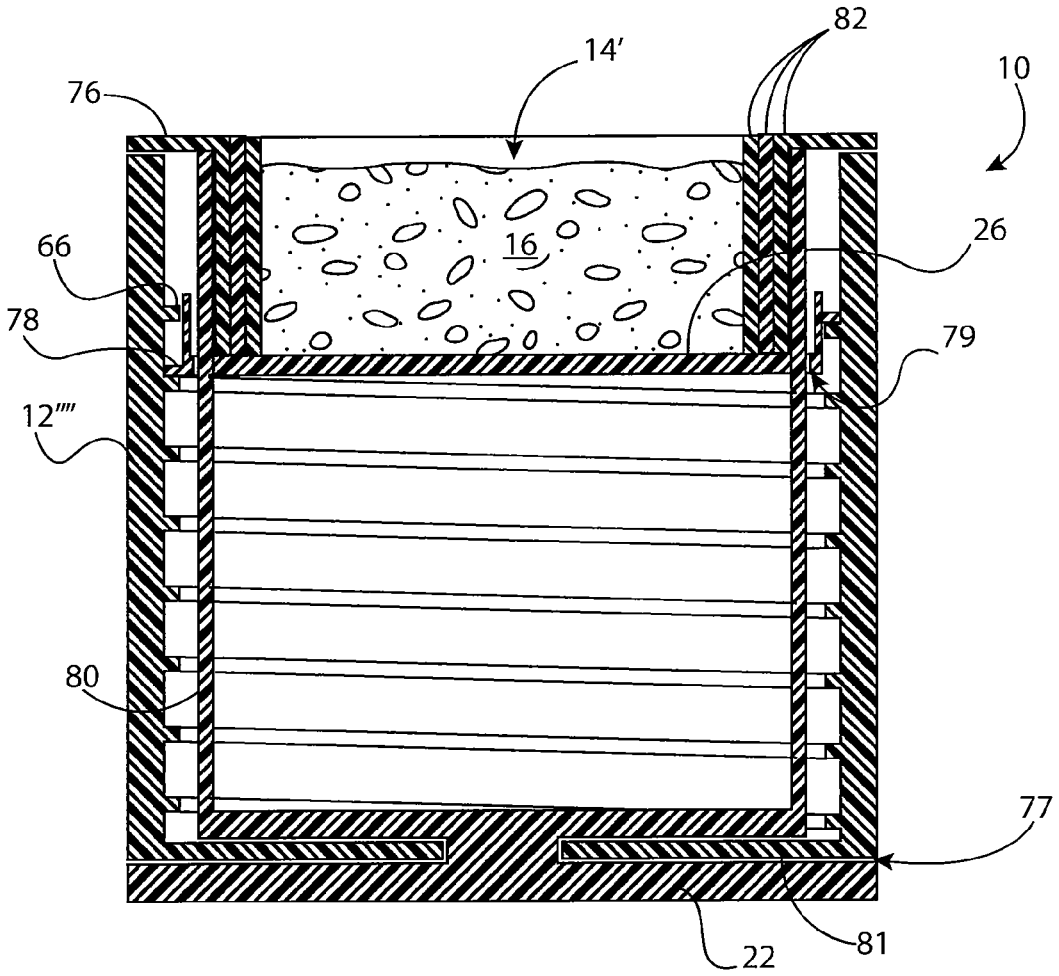
FIG. 16 is a fragmentary version of FIG. 15 showing the container in the partially emptied state with the base elevated.

Referring now to FIG. 16, as the false bottom 26 is elevated, each cylindrical nesting ring 82 may remain stationary until the false bottom 26 is level with the bottom of the cylindrical nesting ring 82, at which point the ring 82 is pushed upward along with the false bottom 26. When the false bottom 26 is positioned at a distance from the top lip 76 equal to the height of the cylindrical nesting rings 82, the container 10 now has an interior volume 14' defined by the diameter and height of the smallest nesting ring 82.

Figure 17:
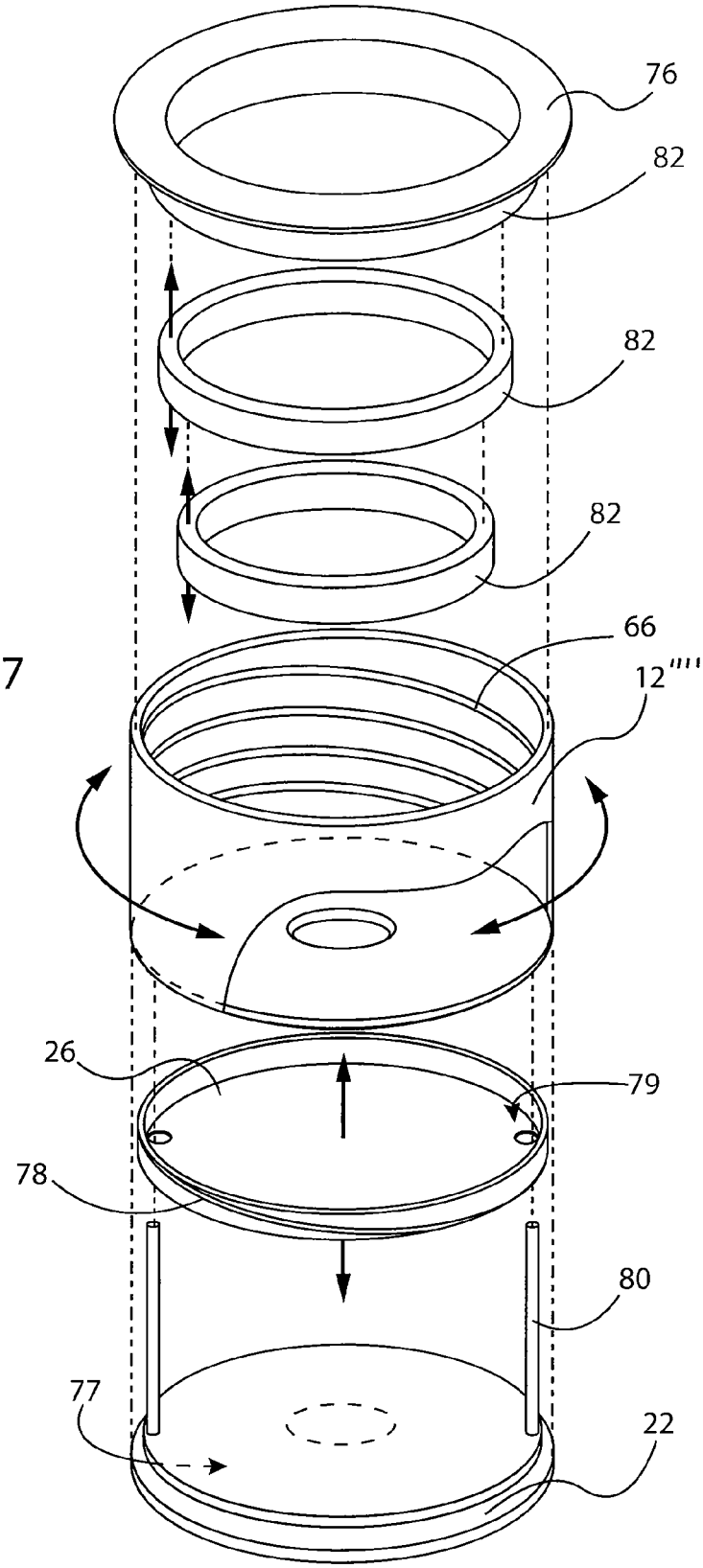
FIG. 17 is an exploded perspective view of the container of the fifth embodiment.

Referring now to FIG. 17, the outer wall 12"" as shown may rotate independently of the other components. Each of the cylindrical nesting rings 82, except for the topmost, moves up and down along with the false bottom 26. The false bottom 26 travels along the vertically extending struts 80. When assembled, the topmost cylindrical nesting ring 82 and the bottom wall 22 remain a fixed distance from each other and neither rotates with respect to the other.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A container comprising:

a base surrounded by substantially rigid upstanding outer sidewalls terminating at an upper lip for receiving a lid, the base movably held within the outer sidewalls to move upward within the outer sidewalls and engaging with an inner surface of the outer sidewalls at a plurality of different selected heights to retain the base at the selected heights as the base moves upward; and inner collapsible sidewalls having an upper end elevationally fixed with respect to the upper lip and a lower end elevationally movable with but separate from the base so the base may push upward on the inner collapsible sidewall to collapse the inner collapsible sidewalls wherein when the base is fully downward, an inner volume defined by a space within the inner collapsible sidewalls is a preponderance of the volume defined by the space between the outer sidewalls and greater than a volume between the inner collapsible sidewalls and the outer sidewalls and wherein the space between the inner collapsible sidewalls and the outer sidewall is substantially blocked from access at the upper lip within a portion receiving the lid.

2. The container of claim 1 wherein the inner collapsible sidewalls comprise a set of telescoping rings.

3. The container of claim 1 further including a set of interengaging thread elements having a first portion attached to the base so that relative rotation of the inter-engaging thread elements causes upward movement of the base.

4. The container of claim 3 wherein a second portion of the inter-engaging thread elements is a helical groove attached to an inner wall of the upstanding outer sidewalls so that rotation of the base causes it to climb upward within the outer sidewalls.

5. The container of claim 3 further including a knob rotatable about a vertical axis and communicating with the base to rotate the base with rotation of the knob.

6. The container of claim 5 wherein the knob provides an outer base to the container.

7. The container of claim 5 wherein the knob further includes upwardly extending pins positioned between the upstanding outer sidewalls and the inner collapsible sidewalls to be received within channels in the base to cause rotation of the base while permitting separation of the base and knob with rotation of the knob.

8. The container of claim 3 wherein the thread elements comprise a helical groove and a tooth fitting within the helical groove.

9. The container of claim 1 further including a lid releasably attaching to the upper lip to sealingly hold contents within the inner collapsible sidewall.

10. A method of dispensing a non-rigid product from a container, the container being of a type having a base surrounded by substantially rigid upstanding outer sidewalls terminating at an upper lip for receiving a lid, the base movably held within the outer sidewalls to move upward within the outer sidewalls and engaging with an inner surface of the outer sidewalls at selected heights to retain the base at the selected heights as the base moves upward and further having inner collapsible sidewalls having an upper edge elevationally fixed with respect to the upper lip and a lower edge elevationally movable with but separate from the base so the base may push upward on the inner collapsible sidewall to collapse the inner collapsible sidewalls, the method comprising the steps of:

(a) positioning the base at a lower most position within the outer sidewalls;

(b) filling the inner collapsible sidewalls with the substantially non-rigid product; and (c) repeating the steps of removing the product from an upper portion of the container, and pushing upward on the base to collapse the inner collapsible sidewalls and raise a level of the product within a container wherein when the base is fully downward, an inner volume defined by a space within the inner collapsible sidewalls is a preponderance of the volume defined by the space between the outer sidewalls and greater than a volume between the inner collapsible sidewalls and the outer sidewalls and wherein the space between the inner collapsible sidewalls and the outer sidewall is substantially blocked from access at the upper lip within a portion receiving the lid.

11. The method of claim 10 wherein the inner collapsible sidewalls comprise a set of telescoping rings.

12. The method of claim 10 further including a set of inter-engaging thread elements having a first portion attached to the base so that relative rotation of the inter-engaging thread elements causes upward movement of the base.

13. The method of claim 12 wherein a second portion of the inter-engaging thread elements is a helical groove attached to an inner wall of the upstanding outer sidewalls so that rotation of the base causes it to climb upward within the outer sidewalls.

14. The method of claim 12 further including a knob rotatable about a vertical axis and communicating with the base to rotate the base with rotation of the knob.

15. The method of claim 14 wherein the knob provides an outer base to the container.

16. The method of claim 14 wherein the knob further includes upwardly extending pins positioned between the upstanding outer sidewalls and the inner collapsible sidewalls to be received within channels in the base to cause rotation of the base while permitting separation of the base and knob with rotation of the knob.

17. The method of claim 12 wherein the thread elements comprise a helical groove and a tooth fitting within the helical groove.

18. The method of claim 10 further including a lid releasably attaching to the upper lip to sealingly hold contents within the inner collapsible sidewall.

* * * * *